US006972731B2

(12) United States Patent
Schadler

(10) Patent No.: US 6,972,731 B2
(45) Date of Patent: Dec. 6, 2005

(54) SERIES FEEDING SYSTEM AND METHOD FOR INTERLEAVED ANTENNAS SHARING THE SAME APERTURE CENTERLINE

(75) Inventor: John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 135 days.

(21) Appl. No.: 10/747,157

(22) Filed: Dec. 30, 2003

(65) Prior Publication Data

US 2005/0146482 A1 Jul. 7, 2005

(51) Int. Cl.[7] ..... H01Q 21/00
(52) U.S. Cl. ..... 343/853; 343/850; 343/890
(58) Field of Search ..... 343/893, 895, 343/743, 879, 890–891, 850, 853, 874

(56) References Cited

U.S. PATENT DOCUMENTS

| | | | | |
|---|---|---|---|---|
| 6,320,555 | B1 * | 11/2001 | Schadler | 343/791 |
| 6,650,300 | B2 * | 11/2003 | Skalina et al. | 343/791 |
| 6,914,579 | B2 * | 7/2005 | Schadler | 343/890 |
| 2005/0088360 | A1 * | 4/2005 | Schadler | 343/850 |

* cited by examiner

*Primary Examiner*—Thuy Vinh Tran
(74) *Attorney, Agent, or Firm*—Baker & Hostetler LLP

(57) ABSTRACT

An antenna feed system for an interleaved series fed antennas is provided, wherein the interleaved antennas share the same centerline. The antenna systems are fed in series from parallel feedlines while preserving similar coverage and maintaining similar aperture space.

20 Claims, 3 Drawing Sheets

SERIES FEEDING SYSTEM AND METHOD FOR INTERLEAVED ANTENNAS SHARING THE SAME APERTURE CENTERLINE

FIELD OF THE INVENTION

The present invention relates generally to an antenna feed system. More particularly, the present invention relates to series feeding interleaved antennas sharing the same aperture centerline.

BACKGROUND OF THE INVENTION

FM radio is in wide use in the field of radio broadcast. The term FM includes, for example, any of the Frequency Modulation methodologies used or developed for signal broadcasting in a frequency band assigned by the U.S. Federal Communications Commission (FCC), nominally in the transmission range 88 MHz to 108 MHz, which is near the middle of the Very-High-Frequency (VHF) television broadcast band. These Frequency Modulation technologies include both analog FM and digital FM.

The FCC has adopted a standard for analog-digital FM transmission called the iBiquity IBOC (In-Band-On-Channel) for hybrid analog-digital transmission systems. According to the IBOC standard, FM stations in the United States must be able to simultaneously broadcast analog and digital signals within their current allocated frequency range. One approach for achieving the above simulcast is to use two separate transmission systems (for example, analog-digital) to feed two separate antennas (for example, analog-digital). Since the elevation of the antenna on the tower directly affects the antenna's coverage, it would be desirable to co-locate the radiated analog and digital signals at the same height above the ground to maintain the same coverage.

Also, since the azimuthal pattern of an FM antenna is very dependent on the cross section of the tower structure, it would be desirable to mount both the analog and digital antennas in the same orientation with respect to the tower. When adding digital coverage, concerns are that many towers are already full having no additional aperture space available. Therefore, many FM broadcasters have responded by vertically interleaving the second digital antenna within the aperture of their existing analog antenna. One challenge to overcome when antennas are placed in this configuration is a practical feed system which allows for both systems to occupy the same aperture space without deleteriously altering the characteristics of either antenna system or the antenna tower.

Accordingly, it is desirable to provide systems and methods which enable a plurality of antenna systems sharing a common centerline to be fed in a manner that does not deter from the performance of the antennas or degrade the structural integrity of the antenna tower.

SUMMARY OF THE INVENTION

The foregoing needs are met, to a great extent, by the present invention, wherein systems and methods are provided wherein a plurality of antenna systems, being interleaved and sharing a common centerline, are independently series fed using offset feedlines and dividing tees.

For example, in accordance with one embodiment of the present invention, an antenna feed system for series feeding interleaved antennas sharing a common centerline is provided, comprising a feedline tap housing having a first and second substantially vertical-facing apertures collinear and substantially opposite each other at one portion of the housing to enable insertion of a substantially vertical antenna feedline therein. Also, a third substantially horizontal-facing aperture at an opposite portion of the housing is provided, the third aperture being orientated substantially orthogonal to the first aperture to enable insertion of an substantially horizontal antenna support centerline.

In accordance with another embodiment of the present invention, an antenna feed block for interleaved series fed antennas, sharing a common centerline is provided, comprising an antenna-to-feedline coupling means for series coupling the feedline to the interleaved antennas, the coupling means comprising a first and second substantially vertical-facing apertures collinear and substantially opposite each other at one portion of the coupling means to enable insertion of a substantially vertical antenna feedline therein. Also, a third substantially horizontal-facing aperture at an opposite portion of the coupling means is provided, the third aperture being orientated substantially orthogonal to the first aperture to enable insertion of an substantially horizontal antenna support centerline.

In accordance with yet another embodiment of the present invention, a method for feeding interleaved antennas is provided, comprising interleaving antennas that share a common centerline and supplying a first and second vertical feedlines offset from and on opposite sides of the common centerline to the interleaved antennas. Also, the method provides for the series feeding antennas of a first interleaved antenna set by tapping at an interleaved interval the first vertical feedline and a series feeding antennas of a second interleaved antenna set by tapping at an interleaved interval the second vertical feedline, wherein the tapping of the first and second feedline is performed using a housing that is reversibly applicable to either the first or second feedline.

In accordance with yet another embodiment of the present invention, a method for feeding two sets of interleaved antennas sharing a common centerline is provided, the method comprising feeding a first interleaved antenna of a first antenna set using a series feed, and feeding a second interleaved antenna of a second antenna set using a separate series feed, wherein the feed is centrally accommodated to enable the series feed to pass through to feed a next interleaved antenna of the first antenna set.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways within the preview of one of ordinary skill in the art. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
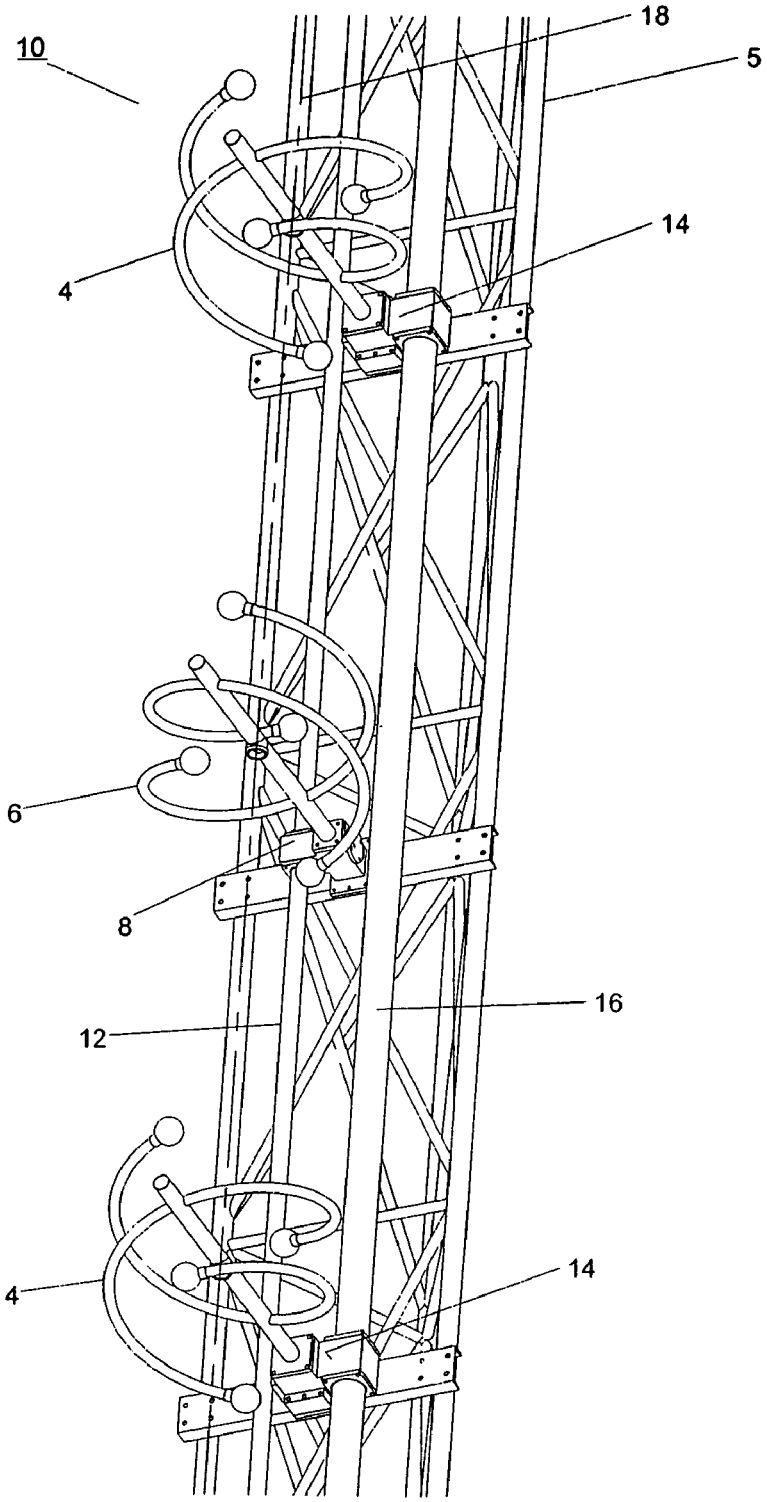
FIG. 1 is an illustration of an interleaved antenna systems with an exemplary feed according to this invention.

The invention will now be described with reference to the drawing figures, in which like reference numerals refer to like parts throughout.

Due to the FCC IBOC requirements several practitioners in the antenna community have devised methods or systems for interleaving antennas. For example, U.S. patent application Ser. No. 10/396,818, titled "Apparatus and Method of Isolating In-Channel FM Antennas Sharing Common Aperture Space" filed Mar. 26, 2003 by the present inventor, the contents of which are incorporated herein by reference in its entirety describes the generic possibility of interleaving antennas. U.S. patent application Ser. No. 10/692,688, titled "Feed System and Method for Interleaving a Branch Feed Antenna with an Existing Series Feed Antenna Within the Same Aperture Centerline", filed Oct. 27, 2003, by the present inventor, the contents of which are incorporated herein by reference in its entirety, describes a branch series feed scheme. In contrast, series feeding multiple interleaved antennas having a common aperture centerline is described herein.

FIG. 1, an illustration 10 of an exemplary radiating tower 5 with interleaved digital left-hand polarized antennas 6 within the same centerline of analog right-hand polarized antennas 4. By interleaving the digital left hand-polarized antennas 6 with the analog right-hand polarized antennas 4, coupling between the antennas 4 and 6 is greatly reduced. Therefore, only a small, low cost circulator is need at the output of the respective transmitter (not shown) to absorb the small amount of coupled energy to achieve the necessary isolation between the two antenna 4 and 6. Since both the digital and analog antennas 6 and 4 have the same approximate tower geometry adjacent to them, the elevation patterns of both systems will be virtually the same and will meet FCC pattern requirements. It should be appreciated that while FIG. 1 only illustrates one left-hand polarized antenna 6 interleaved between two right-hand polarized antennas 4, an additional one or more left-hand polarized antennas 6 may be interleaved above or below the right-hand polarized antenna 4.

Antenna 6 is shown in FIG. 1 as being fed from a tee feed or feed input block 8 which is attached to a feedline 12 attached to the tower 5. A secondary interleaved antenna 6 (not shown) is separated from the visible antenna 6 by approximately 1λ to provide in-phase constructive interference. The counter polarized antennas 4 are interleaved with respect to each other at 1λ intervals within neighboring antennas 6 and are fed by feedline 16 that is fed into the feed input bay 14.

Feedlines 12 and 16 are illustrated as being positioned on "opposite" sides of the centerline 18 of the antennas 4 and 6. Feedline 12 is shown with a smaller diameter than feedline 16 to infer that feedline 12 and the attendant antenna(s) 6 require a lower power than supplied by feedline 16. It should be apparent that the interleaving of antennas 6 and 4, respectively, over a common centerline of a face of the tower 5 results in all of antennas 6 and 4 to be separately fed by feedlines 12 and 16, respectively. Therefore, while FIG. 1 illustrates the "bottom-most" antenna 4 as being fed by feedline 16, the design could be alternated to where the "bottom-most" antenna is antenna 6. In this event, the "top-most" antenna would be another antenna 6.

It should be appreciated by one of ordinary skill in the art that while the above discussion phrases the various elements of the exemplary embodiment of FIG. 1 in terms of bottom-most and top-most, or primary and secondary, or analog and digital, these terms are relative and may be exchanged depending on the design and preferences implemented. Also, while 1λ spacing is used between antennas of the same polarization, other spacings as deemed efficient maybe used. Furthermore, it should be appreciated that while FIG. 1 illustrates the feedline 16 as feeding antennas 4 from the right side of the tower 5, alternative positioning of the feedline 16 may be accomplished. That is, the feedline 16 may be placed on the left side of the tower 5 face and, additionally, the feed 12 may be placed on the right side of the tower 5 face. Further, two or more faces of the tower 5 may have antenna systems located therein. Similarly, rather than positioning the antenna system solely on a face, the antenna system may be positioned on "corners" or at other suitable locations of the tower. Additionally, while the tower 5 is shown to have three faces, the tower 5 can have more or less faces as desired.

In FIG. 1, each antenna 4 and 6 of the sets of antenna shown is composed of circularly polarized helically wound antennas. The antenna elements of the respective analog-digital systems are oppositely polarized between the digital and analog antennas to achieve a high level of isolation, being co-located in the same aperture window. As is apparent to one of ordinary skill, numerous types of non-helical antenna elements are available that can radiate circularly polarized signals and are thus suitable for simulcasting an analog and digital signal in a single aperture window. While some antenna types do not intrinsically radiate circularly polarized signals, they can be forced to create such a signal when driven by properly configured antenna elements and/or phasing. For example, two sets of crossed linear dipoles may be properly phased to generate opposing circular polarizations. Therefore, while the above exemplary embodiments illustrate one style of antenna elements, other forms of antennas, either by physical or by signal manipulation, may generate orthogonal signals to achieve reduced cross-coupling.

Due to the exemplary interleaving and feed approach provided in FIG. 1, a very low cost solution to FCC requirements is provided. Specifically, the cost of the secondary (digital) antenna 6, second run of low power (digital) transmission line and low power circulator is substantially less than the system cost of a 10 dB coupler and a transmitter large enough to compensate for additional system losses.

Also, the exemplary system 10 also provides a lower risk as each of the analog and digital arrays are separate from each other and, therefore, can be operated independently. Because of the reduced mutual coupling, re-tuning requirements of the analog antenna after installing the digital bays can be minimized. Additionally, two interleaved antennas 4 and 6 provide a level of redundancy since both arrays are capable of supporting either the analog or digital signal based on the input signal.

While FIG. 1 only illustrates three input feed blocks 8 and 14 situated on the tower 5, less or more input feed blocks may be facilitated, based on power, antenna patterns, etc.

Figure 2:
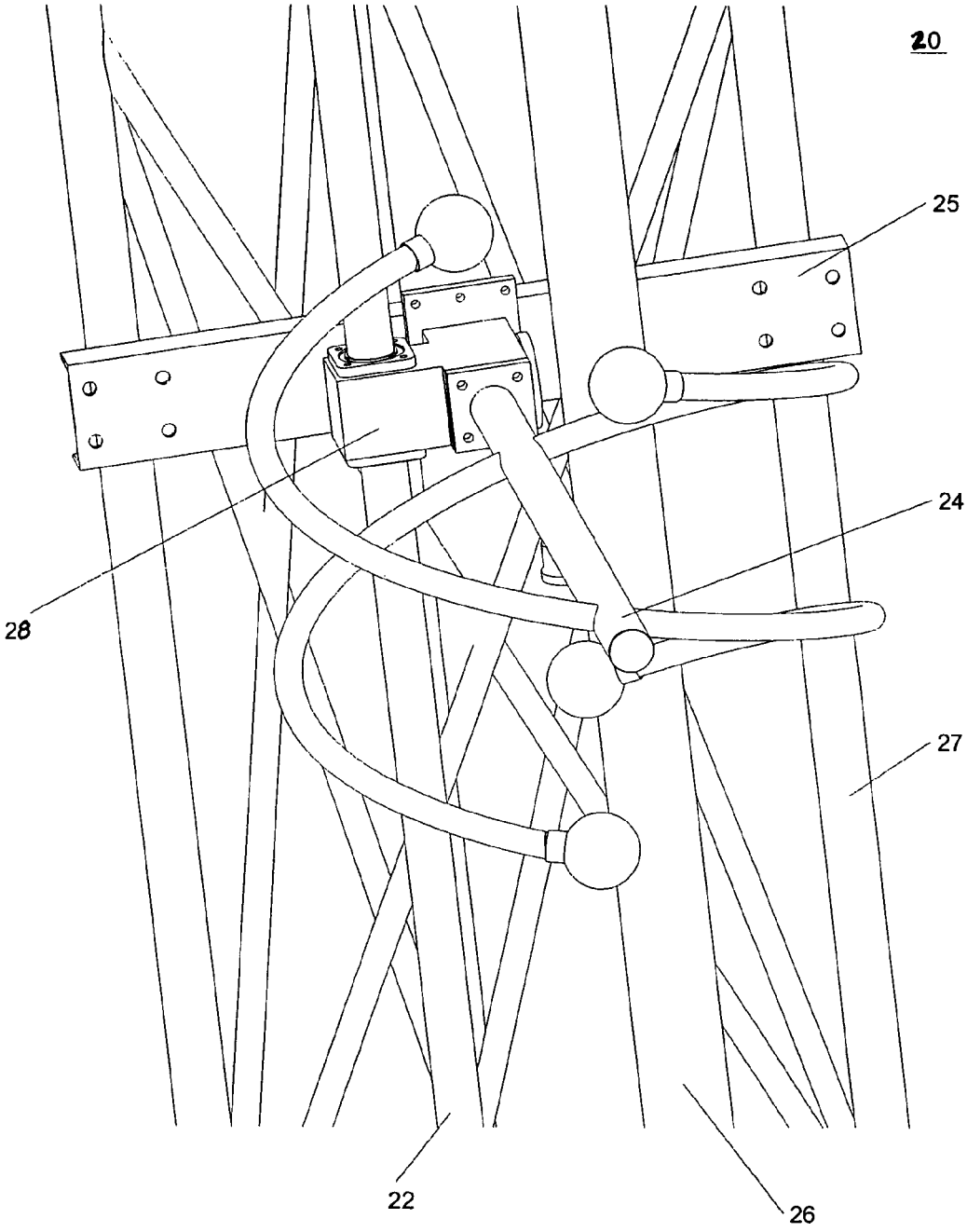
FIG. 2 is a closeup illustration of an exemplary feed of FIG. 1.

FIG. 2 is an illustration showing a closeup view of an exemplary input feed block 28. The input feed block 28 is shown coupled to the feedline 22 and to the antenna 24. The input feed block 28 is secured to the face of the antenna tower 27 via a mounting plate 25 that is attached to the face of the antenna tower 27 via mounting clamps (not shown). Of course, it should be appreciated that other forms of attachment to the tower 27 may be accomplished with, for example, bolt, welds, screws, etc. The exemplary input feed block 28 is positioned on the mounting plate 25 to afford the coupled antenna 24 a centerline location. The exemplary input feed block 28 is shown as only coupling to the feedline 22 and, therefore, is disassociated from the neighboring feedline 26.

The exemplary feed block 28 is of a sufficient size to border the centerline of the tower 27 and accommodate the antenna 24 at the centerline, and also extend to an adjacent feedline 22, for example. The design of the exemplary feed block 28 permits the easy reversal of the exemplary feed block 28 to enable coupling to an "opposite" feedline, for example, feedline 26 as shown in FIG. 2, if desired. Thus, by using the exemplary feed block 28 design, series coupling of the interleaved antennas to feedlines 22 and 26 that run up the tower 27 can be accomplished by using one type of feed block 28, rather than different types for the different feedlines.

As is obvious from FIG. 2 the feedline 22 is of a smaller diameter than the feedline 26. To accommodate the ability to have a one size fits all approach, the interface between the feedline 22 and the opening of the exemplary input feed block 28 is fitted with a sizing ring 21 to enable a secure fit of the feedline 22 to the exemplary input feed bay 28. In other words, the exemplary input feed block 28 may be designed with a feedline interface opening that can accommodate the larger diameter (or less) of the feedline 26.

Figure 3:
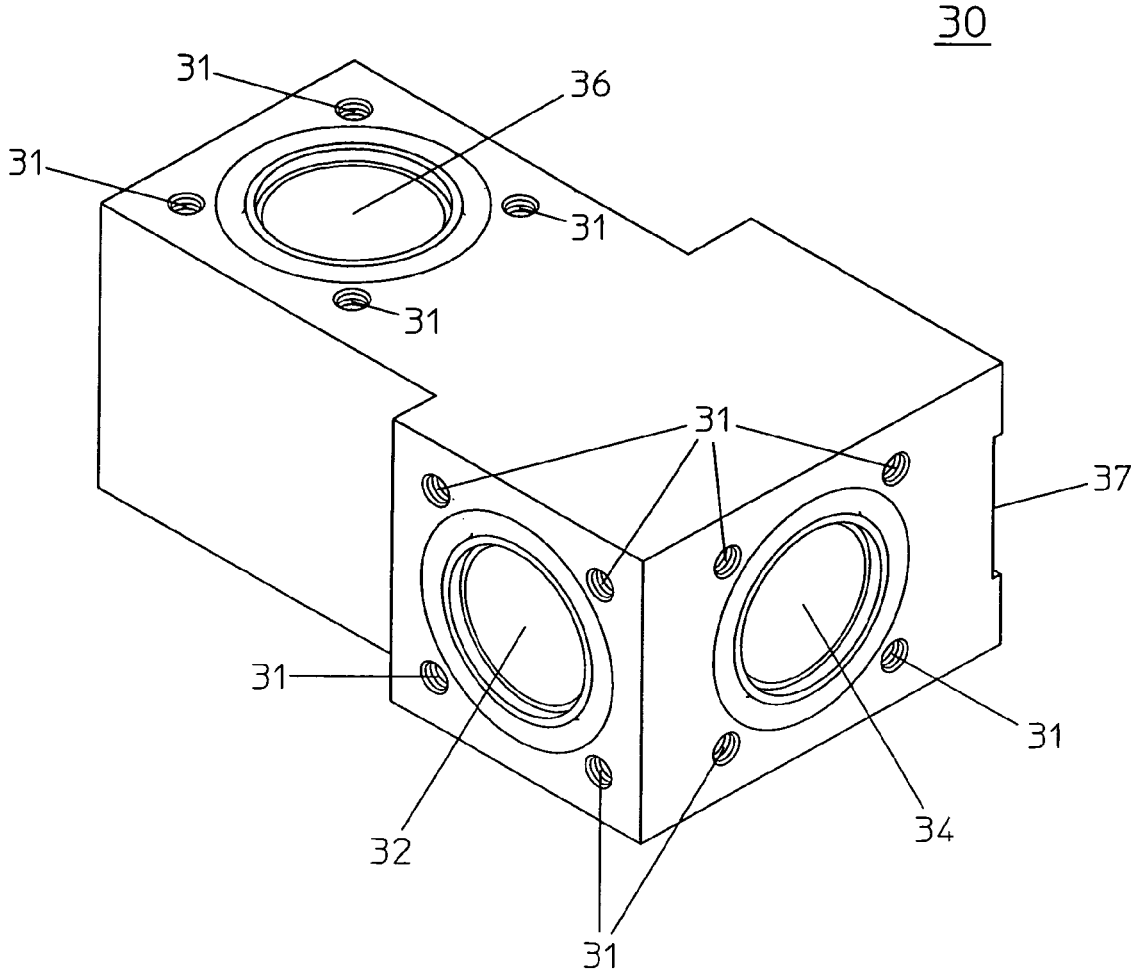
FIG. 3 is an perspective illustration of an offset feed block.

FIG. 3 is a perspective view of an exemplary input feed block 30. The illustrated exemplary input feed block 30 is shown as having the general shape of a tee with openings 32 and 34 positioned on adjoining faces of the right portion of the exemplary input feed block 30. The opening 32 is positioned on an outward face of the exemplary input feed block 30, and accommodates the placement of an antenna boom (not shown) for coupling to an antenna (see FIGS. 1 and 2). Opening 34 is provided to enable easy access to the interior of the exemplary input feed block 30, as well as to accommodate extensions or bridges, if necessary. Opening 36 is shown as being positioned on a top face of the exemplary input feed block 30 and is provided for securing the respective tapped feedline. A recessed surface 37 is shown in FIG. 3 at a "rear" portion of the exemplary input feed block 30. The recessed surface 37 is provided for convenient mating to the mounting plate as discussed in FIG. 2. Each of the openings 32, 34 and 36 are flanked by holes 31 to facilitate the mating of connecting flange. In the event that bridge or extensions not needed, the sizing plate for opening 34 can be a solid plate to seal the opening 34 or, alternatively, the feed block 30 may be fabricated without the opening 34 or the attendant holes 31.

It should be appreciated that while the exemplary embodiments of the input feed block, discussed above, are illustrated in the Figures as having a predominant "tee" shape, other shapes or forms may be suitable for accomplishing the desired result. Additionally, terms as right, left, front, back, outward, etc. are understood to be relative terms and may be interchanged depending on the orientation chosen. Furthermore, additional openings may be placed in the input feed block for draining, inspection, etc. Also, the input feed block may be fabricated from several pieces and joined to form a single assembly upon completion or mounting to the tower.

It should be appreciated that though the above exemplary embodiments are described in the context of IBOC applications, non-IBOC applications may be contemplated. For example, any antenna system requiring "sharing" of a centerline can utilize the features of the present invention to provide a convenient series fed arrangement.

Accordingly, many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna feed system for series feeding interleaved antennas sharing a common centerline, comprising:

a feedline tap housing having:

a first and second substantially vertical-facing apertures collinear and substantially opposite each other at one portion of the housing to enable insertion of a substantially vertical antenna feedline therein; and a third substantially horizontal-facing aperture at an opposite portion of the housing, the third aperture being orientated substantially orthogonal to the first aperture to enable insertion of a substantially horizontal antenna support centerline.

2. The antenna feed system according to claim 1, further comprising:

a fourth substantially horizontal-facing aperture at the opposite portion of the housing, being substantially orthogonally to the third aperture to enable access to an interior of the housing.

3. The antenna feed system according to claim 1, wherein the housing is reversible about a vertical axis bisecting a center of the third aperture to enable the first and second apertures of the housing to accommodate an other substantially vertical antenna feedline therein, when the housing is reversed.

4. The antenna feed system according to claim 1, further comprising:

a plurality of fitting plate mounting holes disposed about the first, second, and third apertures.

5. The antenna feed system according to claim 4, wherein the mounting holes are threaded.

6. The antenna feed system according to claim 1, further comprising:

a first and second fitting plate that seal the housing to the vertical feedline; and a third fitting plate that seals the antenna support to the housing.

7. The antenna feed system according to claim 1, further comprising:

an attachment detent at a rear portion of the housing.

8. The antenna feed system according to claim 1, wherein the housing is in the shape of a tee.

9. The antenna feed system according to claim 1, wherein an inner edge of the first, second and third apertures are threaded.

10. An antenna feed block for interleaved series fed antennas, sharing a common centerline, comprising:

an antenna-to-feedline coupling means for series coupling the feedline to the interleaved antennas, the coupling means comprising:

a first and second substantially vertical-facing apertures collinear and substantially opposite each other at one portion of the coupling means to enable insertion of a substantially vertical antenna feedline therein; and a third substantially horizontal-facing aperture at an opposite portion of the coupling means, the third aperture being orientated substantially orthogonal to the first aperture to enable insertion of a substantially horizontal antenna support centerline.

11. The antenna feed block according to claim 10, wherein the coupling means is reversible about a vertical axis bisecting a center of the third aperture to enable the first and second apertures of the coupling means to accommodate an other substantially vertical antenna feedline therein, when the coupling means is reversed.

12. The antenna feed block according to claim 10, further comprising:

a fourth substantially horizontal-facing aperture at the opposite portion of the coupling means, being substantially orthogonally to the third aperture to enable access to an interior of the coupling means.

13. The antenna feed block according to claim 10, further comprising:

a plurality of aperture fitting means for fitting the coupling means to the feedline and the antenna.

14. A method for feeding interleaved antennas, comprising:

interleaving antennas that share a common centerline;

supplying a first and second vertical feedlines offset from and on opposite sides of the common centerline to the interleaved antennas;

series feeding antennas of a first interleaved antenna set by tapping at an interleaved interval the first vertical feedline;

series feeding antennas of a second interleaved antenna set by tapping at an interleaved interval the second vertical feedline, wherein the tapping of the first and second feedline is performed using a housing that is reversibly applicable to either the first or second feedline.

15. The method for feeding interleaved antennas according to claim 14, further comprising:

securing the housing to the first feedline through a connecting flange and securing the housing to the second feedline through another connecting flange.

16. The method for feeding interleaved antennas according to claim 15, wherein the feedline-flanges are secured to the housing via bolts.

17. The method for feeding interleaved antennas according to claim 15, wherein the feedline-flanges are mated to the housing via threads on the housing.

18. The method for feeding interleaved antennas according to claim 14, further comprising:

securing the interleaved antennas to the housing with an antenna-to-housing flange.

19. The method for feeding interleaved antennas according to claim 14, further comprising:

providing a housing access port at a housing side adjoining the centerline.

20. The method for feeding interleaved antennas according to claim 14, further comprising:

securing the housing to a tower supporting the interleaved antennas.

* * * * *